United States Patent [19]

Casson

[11] 4,192,030

[45] Mar. 11, 1980

[54] CAMPING ACCESSORY

[76] Inventor: Alwin E. Casson, 92 Laurel La., Lunenburg, Mass. 01462

[21] Appl. No.: 909,823

[22] Filed: May 26, 1978

[51] Int. Cl.[2] ..... A47G 9/00

[52] U.S. Cl. ..... 5/420; 5/93 R; 5/450; 5/494; 2/69.5

[58] Field of Search ..... 5/92, 94, 97, 98, 120, 5/121, 343–349; 135/1 R; 2/69.5

[56] References Cited

U.S. PATENT DOCUMENTS

| | | | |
|---|---|---|---|
| 2,711,546 | 6/1955 | Licht | 5/343 |
| 3,178,734 | 4/1965 | Carrez | 5/343 |
| 3,278,953 | 10/1966 | Willis | 5/113 |
| 3,323,147 | 6/1967 | Van Dean | 5/94 |
| 3,513,489 | 5/1970 | Miller | 5/98 |
| 3,675,256 | 7/1972 | Kallarico | 5/120 |
| 3,751,741 | 8/1973 | Hendry | 5/343 |
| 3,840,919 | 10/1974 | Middleton | 5/343 |
| 3,860,980 | 1/1975 | Ebert | 5/347 |
| 3,877,092 | 4/1975 | Gasier | 5/343 |
| 3,878,574 | 4/1975 | Erickson | 5/343 |
| 3,988,791 | 11/1976 | Simon | 5/343 |
| 4,023,220 | 5/1977 | Younker | 5/177 |
| 4,031,674 | 6/1977 | Rand | 52/2 |

*Primary Examiner*—Casmir A. Nunberg

*Attorney, Agent, or Firm*—Norman S. Blodgett; Gerry A. Blodgett

[57] ABSTRACT

Camping accessory consisting of inner and outer bag-like envelopes formed with corrugations and sealed together for forming an air-tight enclosure adapted to be filled with air under slight pressure.

9 Claims, 10 Drawing Figures

10
11
12
13
14
15
16
18
19
22
23
24

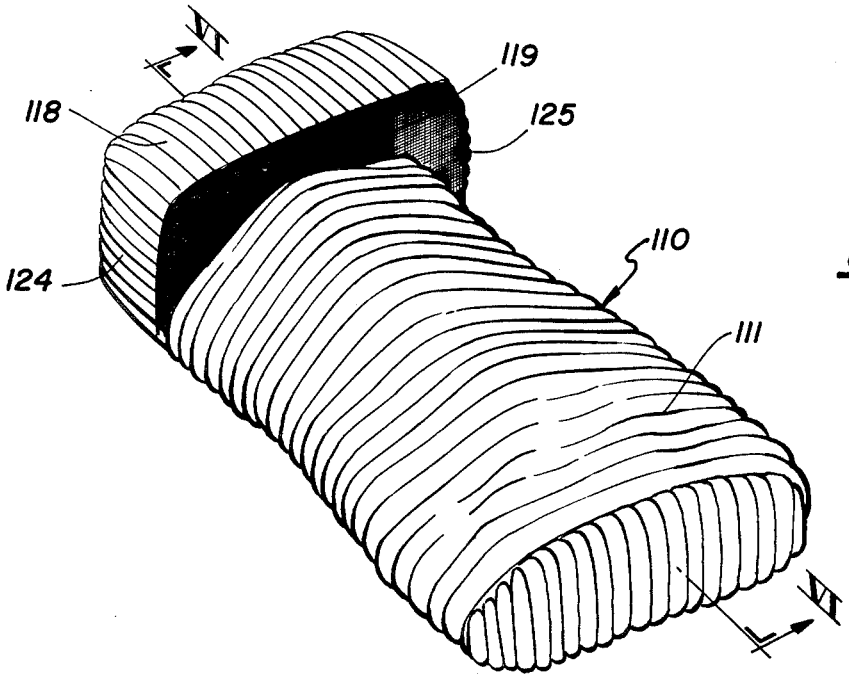
FIG. 5
FIG. 6
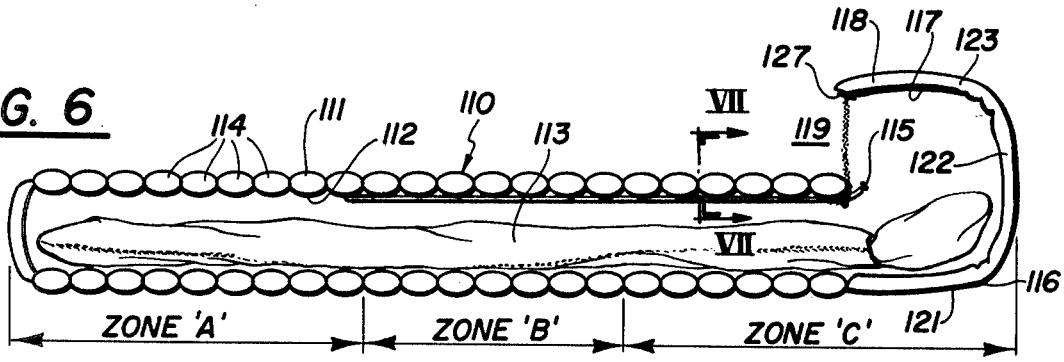
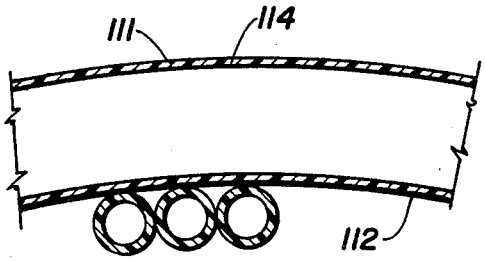
FIG. 7

CAMPING ACCESSORY

BACKGROUND OF THE INVENTION

An activity that has become very popular recently is that of "backpacking", wherein the hiker ventures into the woods and mountains with only the equipment that he can carry on his back. This activity is carried on at all times of the year and in various climates. The hiker will probably carry a sleeping bag, but he will still be faced with the problem of sheltering himself from the rain, remaining warm in cold weather (where only a very heavy sleeping bag would be adequate), and protecting himself from insects. While a tent will protect him from exposure to the rain and wind, it is, nevertheless, a fairly heavy piece of equipment to carry in a backpack. The use of a very heavy sleeping bag to protect him from the cold not only means added weight, but also means that in the summer (where he will not be exposed to the cold) he will have to use a second, lighter sleeping bag. Very few sleeping bags have provision for protection against mosquitoes and flies. None of these provide a comfortable mattress to underlie the sleeping bag. An inflatable mattress would be another heavy element to add to his load. In other words, in order for the person using the sleeping bag to be completely comfortable, he must add to his pack a number of heavy items from time-to-time, all of which may not be useful at any given time. These and other difficulties experienced with the prior art devices have been obviated in a novel manner by the present invention.

It is, therefore, an outstanding object of the invention to provide a camping accessory which simultaneously serves the function of protection from the cold and wind, protection from mosquitoes and flies, protection from the cold, and serves as a soft mattress.

Another object of this invention is the provision of a camping accessory which is light-weight and compact, while serving a multitude of functions.

A further object of the instant invention is the provision of a camping accessory which acts as a cover for a sleeping bag, while protecting it from the rain and serving as a mattress.

It is another object of the instant invention to provide a camping accessory to be used with a sleeping bag to act as a mattress and as a protection from the cold of the ground and cold of the air, the accessory being collapsible into a very small volume.

A still further object of the invention is the provision of a camping accessory capable of use for a large number of functions, yet which is light in weight and can be compressed into a small volume for carrying in a pack.

It is a further object of the invention to provide a camping accessory which is simple in construction, inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a camping accessory, having an outer envelope formed of water-proof sheet material formed with corrugations and having an inner envelope formed of sheet material adapted to lie within the outer envelope. The edges of the two envelopes are connected together to form an air-tight enclosure. A valve is provided to inflate the enclosure with a slight air pressure.

More specifically, both envelopes are formed of a polymer plastic sheet connected together by means of thermal sealing. The inner and outer envelopes are provided with matching extensions that are joined to form a hood. An opening remains between the hood (on the one hand) and the inner and outer envelopes (on the other hand). The extensions that form the hood are joined in an air-tight manner, so that the interior of the hood constitutes an extension of the said enclosure.

BRIEF DESCRIPTION OF THE DRAWINGS

The character of the invention, however, may be best understood by reference to one of its structural forms, as illustrated by the accompanying drawings, in which:

FIG. 5 is a perspective view of a modified form of the camping accessory, FIG. 6 is a longitudinal sectional view of the camping accessory taken on the line VI—VI of FIG. 5, FIG. 7 is a vertical sectional view of a portion of the camping accessory taken on the line VII—VII of FIG. 6, FIG. 9 is a vertical sectional view of the camping accessory showing in use as a water container for taking a bath, and, FIG. 10 is a perspective view of the camping accessory when used in a vertical position as a shelter while hunting or the like.

DESCRIPTION OF THE PREFERRED EMBODIMENT

Figures 1, 4:
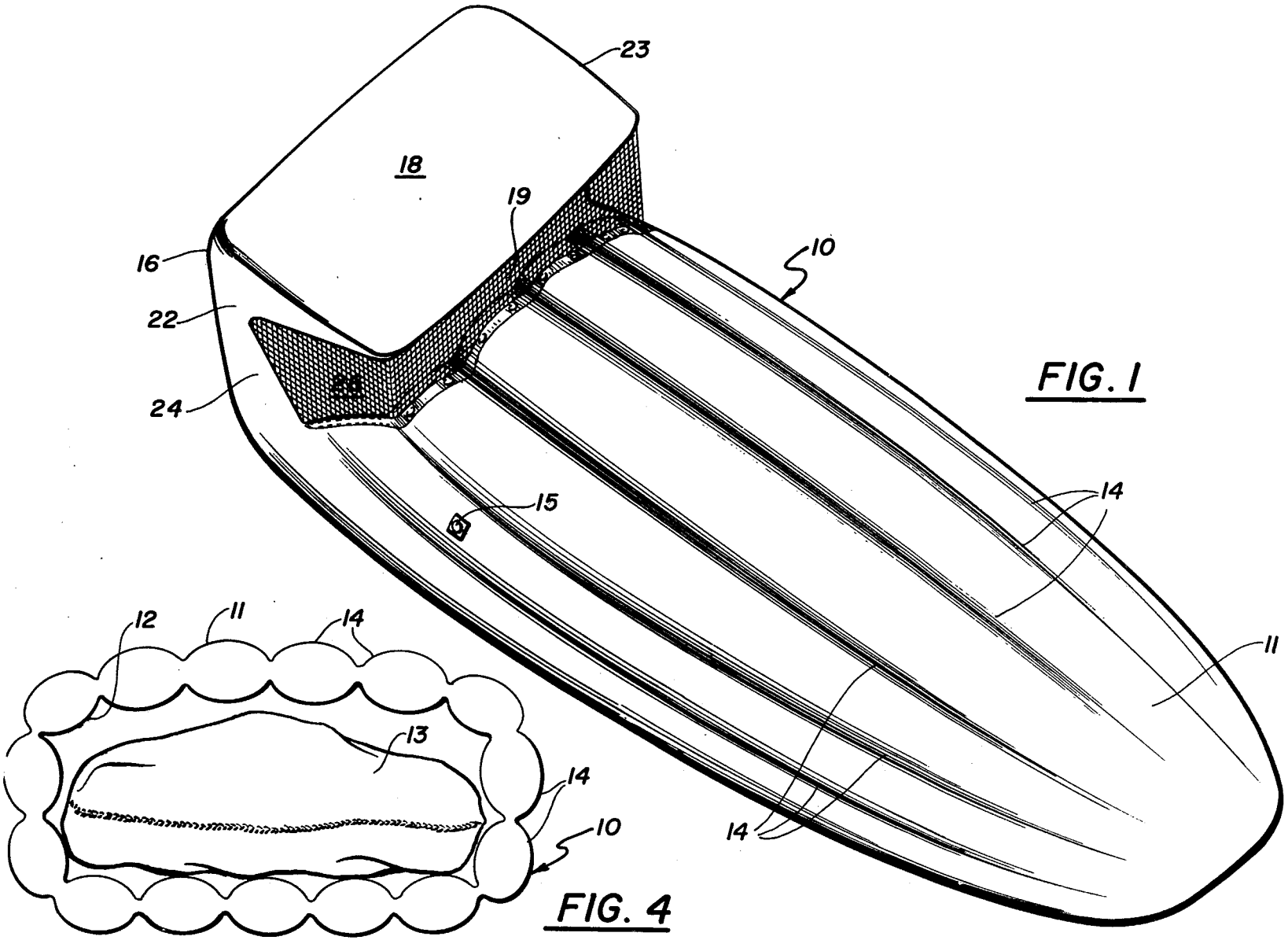
FIG. 1 is a perspective view of a camping accessory embodying the principles of the present invention.
FIG. 4 is a transverse sectional view of the camping accessory taken on the line IV—IV of FIG. 2.
Figure 2:
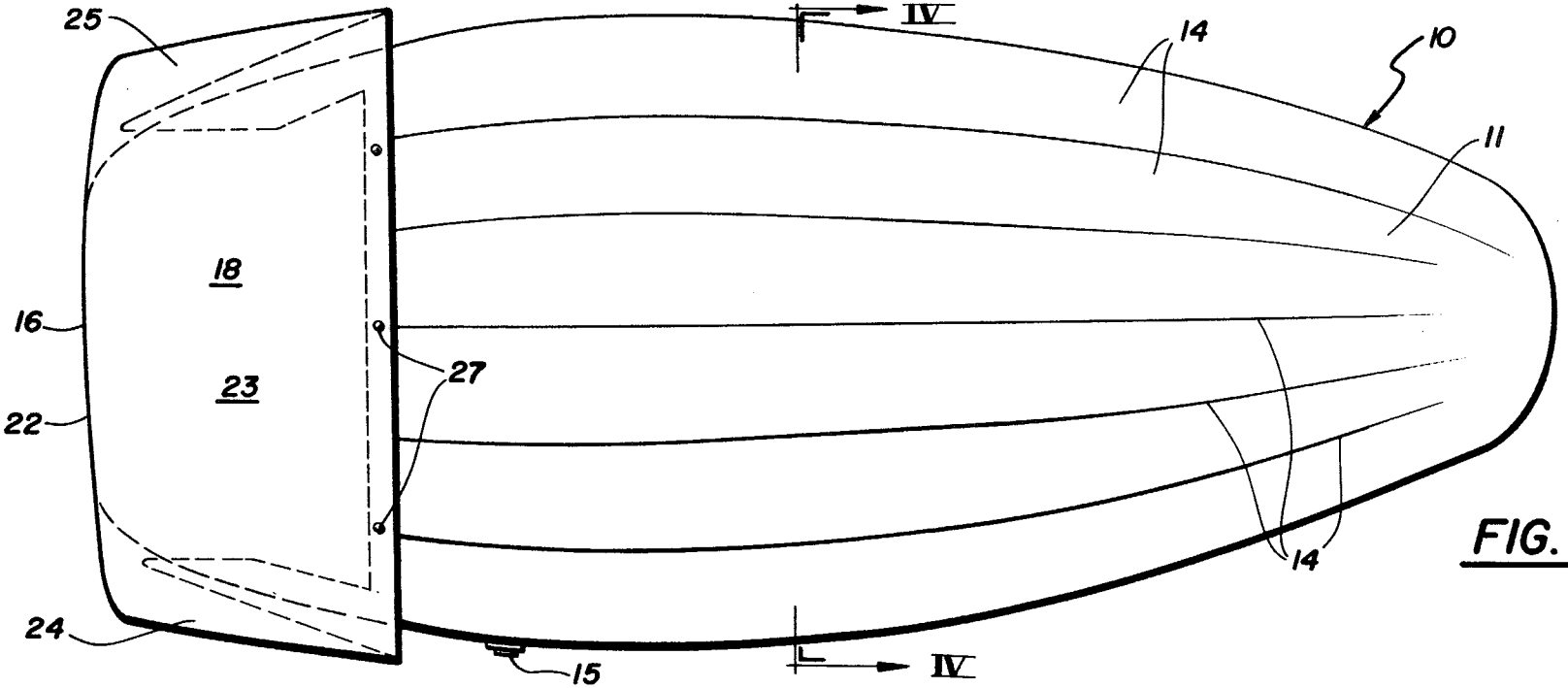
FIG. 2 is a plan view of the camping accessory.
Figure 3:
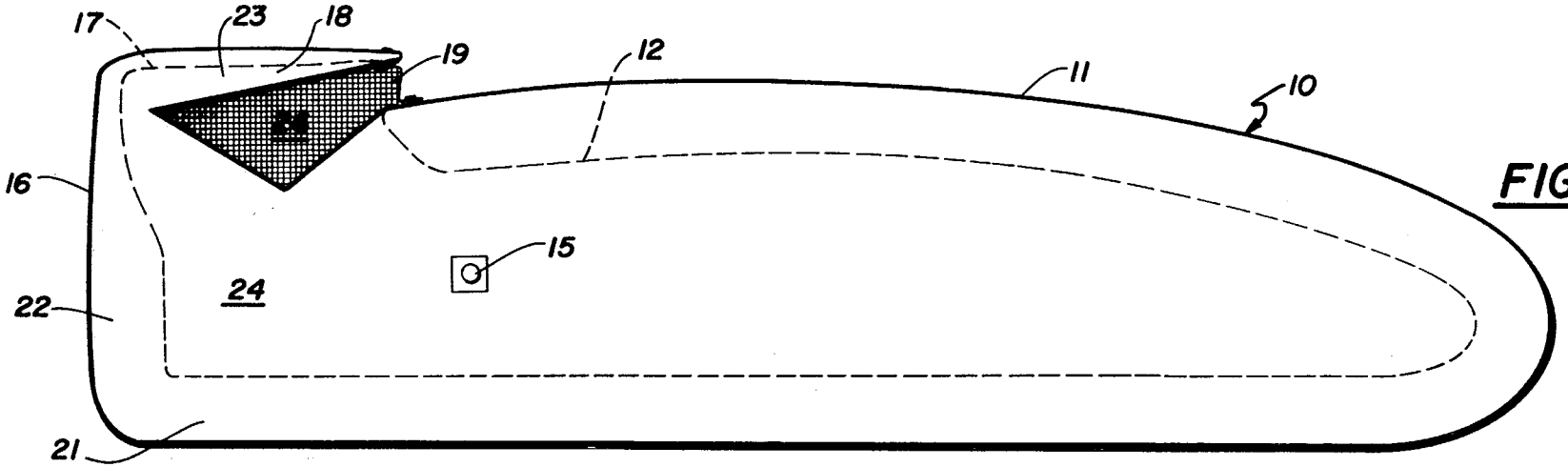
FIG. 3 is a side elevational view of the camping accessory.

Referring first to FIGS. 1, 2, and 3, wherein are best shown the general features of the invention, the camping accessory, indicated generally by the reference numeral 10, is shown laying on the ground in a horizontal position. The accessory is provided with an outer envelope 11 which has a generally bag-like configuration formed from a water-proof sheet material shaped with corrugations 14. Inside of the outer envelope 11 is an inner envelope 12 having somewhat the same, but smaller, configuration and also formed of a water-proof sheet material formed with corrugations. In the preferred embodiment both the outer envelope 11 and the inner envelope 12 are formed of a flexible polymer plastic such as polyvinyl chloride.

The inner and outer envelopes are thermo-sealed along their edges to form an interior, air-tight enclosure between them. A valve 15 mounted on the exterior of the outer envelope to permit the enclosure between the envelopes to be inflated with a slight air pressure.

The inner and outer envelopes are provided with similar extensions 16 and 17, respectively, that are joined at their edges to provide a double-walled hood 18. The opening 19 remains and is defined between the hood 18 on the one hand and the inner and outer envelopes on the other hand. The enclosure between the extension 16 and 17 of the hood has access to the enclosure between the inner and outer envelopes, so that it receives pressure air, when such air is introduced through the valve 15. The hood 18 has a bottom wall 21, a vertical end wall 22, a horizontal top wall 23, and side walls 24 and 25. The free edges of the top wall and the side walls define the opening 19. A mosquito netting 26 extends across the opening 19 and is attached to the edges of the various elements defining the opening by means of fasteners 27 which may be in the form of snap fasteners.

FIG. 4, which is a sectional view through the camping accessory, shows particularly well the manner in which the longitudinal corrugations 14 serve to stiffen the construction in the longitudinal direction to resist bending. It also demonstrates the manner in which the air pressure in the enclosure between the inner and outer envelopes expands the accessory and provides adequate space in the interior for a thin sleeping bag 13, if such be necessary. FIGS. 1 and 3 show the manner in which the side walls 24 and 25 of the hood 18 are provided with cut-outs on their leading edge to make the hood easy to hinge rearwardly when one wishes to enter the interior, either to insert a sleeping bag or for the user to crawl into the enclosure and into the sleeping bag.

The operation of the camping accessory will now be readily understood in view of the above discussion. Normally, the accessory would be carried in a backpack in collapsed and rolled-up condition. It is possible that, with the air emptied out, it can be rolled-up with the sleeping bag 13 in place in its interior, which would serve to protect the sleeping bag from the rain. When it is to be used, it is removed from the pack and laid out horizontally on the ground. Air is introduced through the valve 15 either with the mouth or with a small pump and the valve is closed when the device has been expanded to the condition shown in FIG. 1. With slight air pressure, the accessory is somewhat stiff and, if the sleeping bag is not in its interior, it can be inserted at that time readily. The hood 18 is semi-rigid because of the air in its interior, but can be easily bent rearwardly to allow the user to enter the sleeping bag. The mosquito net would, of course, be unfastened at that time. One he has inserted himself in the interior, he can then refasten the mosquito net and this will keep mosquitoes and black flies from entering the enclosure. It can be seen, then, that the accessory provides a water-proofing for the sleeping bag and for the person using it. Also, he would be resting on a ready-made air mattress. Furthermore, the bottom wall protects him from cold on the ground, while the other walls protect him from the cold air and wind. The shelter afforded is increased when the hood is directed away from the direction from which the wind blows. When the user is through with the accessory, the valve 15 can be opened and, when the accessory is rolled up, the air is pressed from its interior.

FIG. 5 shows a modified form of the invention in which the camping accessory 110 is formed with an outer envelope 111 formed of substantially water-proof sheet material and formed with corrugations 114 which extend transversely of the length of the outer envelope. An inner envelope 112 is formed of sheet material and lies within the outer envelope, the envelopes being joined by heat sealing along their edges to form an air-tight enclosure. A valve 115 is provided to inflate the enclosure with a slight air pressure. The sheet material which both the inner and outer envelope is formed is a flexible polymer plastic. The inner and outer envelopes are provided with similar extensions 116 and 117 that join to form a hood 118, an opening 119 remaining between the hood on the one hand and the inner and outer envelopes on the other hand.

A sleeping bag 113 is shown in FIG. 6 within the inner and outer envelopes. The hood 118 has a bottom wall 121, an end wall 122, a top wall 123, and side walls 124 and 125 which serve to define the hood 118. A netting 126 is provided to pass over the opening 119 and fastenings 127 are provided to hold it in place. The hood 118 is also provided with corrugations which tend to stiffen and hold it in an upright position out of contact with the head of the user.

Figure 8:
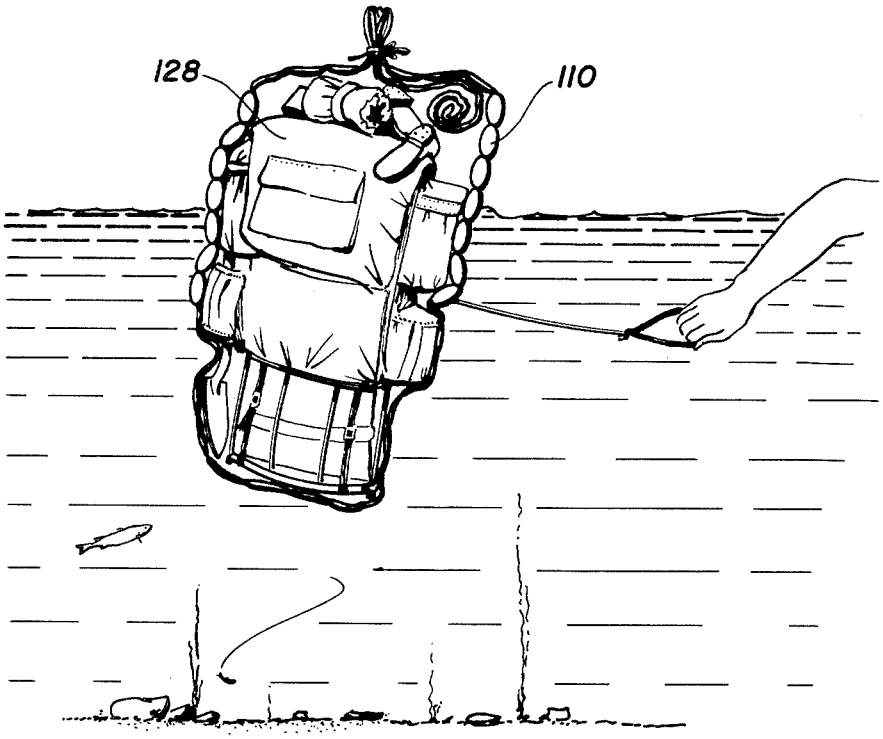
FIG. 8 is a perspective view of a camping accessory shown in use in water.
Figure 9:
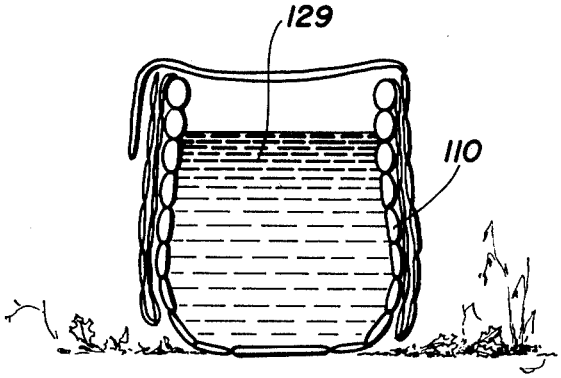
Figure 10:
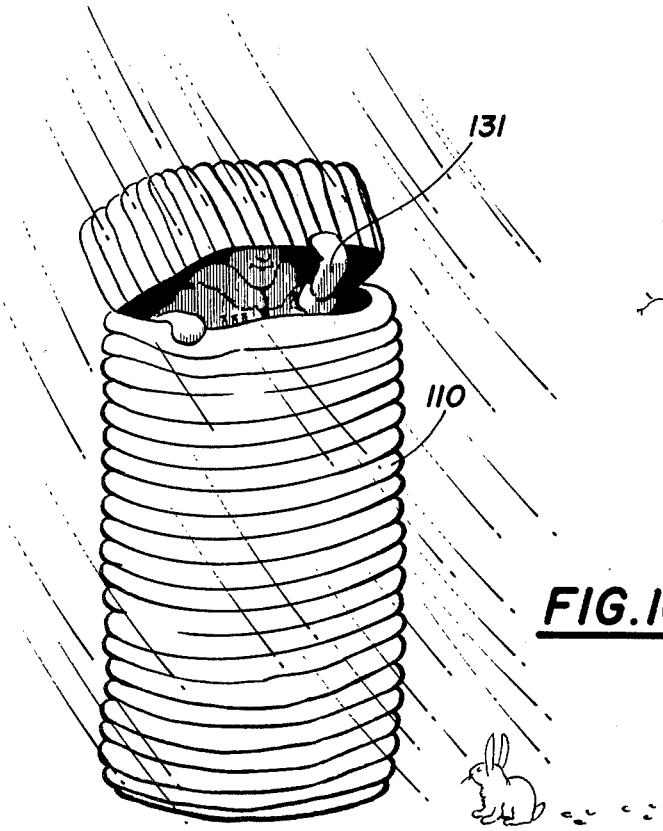

FIGS. 8 through 10 show that the accessory is capable of a number of functions made possible by its particular constructions. In FIG. 8 a pack 128 is shown being carried across a stream and maintained free of water, because of being enveloped in the accessory 110. In FIG. 9 a body 129 of water is held within the interior of the accessory 110 and can be used as a bathtub in that condition. In FIG. 10 the accessory 110 is shown in vertical direction with a hunter 131 hidden in its interior and protected from the wind.

It can be seen then that the present invention has a number of advantages. The accessory incorporates in a single structure equipment acting as a water-proof cover for a sleeping bag, it provides a hood to keep the user's head out of the rain and weather, it provides for protection from mosquitoes and flies, and it insulates against the cold of the ground and of the wind. All of these functions are served within a single structure, thus obviating the need to carry in a backpack a large number of devices, including an air mattress. At the same time, it can be rolled into a very compact, light package by squeezing the air from its interior.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Camping accessory, comprising:

(a) an elongated outer envelope formed of substantially waterproof and air impermeable sheet material with a continuous edge at one end, (b) an elongated inner envelope formed of substantially air impermeable sheet material and lying within the outer envelope, said inner envelope having a continuous edge joined to the continuous edge of said outer envelope to form an airtight enclosure between the outer and inner envelopes, an inner space within said inner envelope and an opening to said inner space at said one end, and (c) a valve for inflating the enclosure with air at superatmospheric pressure.

2. Camping accessory as recited in claim 1, wherein the sheet material of which both the inner and the outer envelope is formed is a flexible polymer plastic.

3. Camping accessory as recited in claim 1, wherein the inner and outer envelopes are provided with similar extensions that are joined to form a hood, said opening remaining between the hood, on the one hand, and the inner and outer envelopes, on the other hand.

4. Camping accessory as recited in claim 3, wherein the hood has bottom, end, and top walls, as well as two side walls joining the other walls to define the said opening.

5. Camping accessory as recited in claim 4, wherein the extensions that form the hood are joined in an air-tight manner, so that the interior of the hood constitutes an extension of the said enclosure.

6. Camping accessory as recited in claim 5, wherein a mosquito netting is provided to close the said opening, and fastenings are provided to fasten the netting to the edge of the opening.

7. Camping accessory as recited in claim 1, wherein the corrugations run lengthwise of the envelopes.

8. Camping accessory as recited in claim 1, wherein the corrugations run transversely of the envelopes.

9. Camping accessory as recited in claim 8, wherein an integral hood surrounds the said opening and is corrugated to render it self-supporting.

* * * * *